United States Patent [19]

Eidt, Jr. et al.

[11] Patent Number: 4,882,036

[45] Date of Patent: Nov. 21, 1989

[54] COMBINATION COKING AND HYDROCONVERSION PROCESS

[75] Inventors: Clarence M. Eidt, Jr., Chatham, N.J.; Clyde L. Aldrige; Roby Bearden, Jr., both of Baton Rouge, La.

[73] Assignee: Exxon Research and Engineering Company, Florham Park, N.J.

[21] Appl. No.: 291,390

[22] Filed: Dec. 27, 1988

Related U.S. Application Data

[63] Continuation of Ser. No. 97,121, Sep. 16, 1987, abandoned.

[51] Int. Cl.[4] ..... C10G 69/06; C10G 69/10

[52] U.S. Cl. ..... 208/50; 208/54; 208/55; 208/127

[58] Field of Search ..... 208/108, 127, 54, 55, 208/57, 61, 81, 85, 50; 210/496, 494.2, 499

[56] References Cited

U.S. PATENT DOCUMENTS

| | | | |
|---|---|---|---|
| 2,789,082 | 4/1957 | Barr et al. | 208/55 |
| 2,853,434 | 9/1958 | Moser, Jr. | 208/54 |
| 2,905,617 | 9/1959 | Jahnig et al. | 208/55 |
| 3,033,783 | 5/1902 | Lubben | 210/496 |
| 3,238,117 | 3/1966 | Arey, Jr. et al. | 208/85 X |
| 4,072,616 | 2/1978 | Rohlig | 210/496 X |
| 4,134,825 | 1/1979 | Bearden, Jr. et al. | 208/213 X |
| 4,569,751 | 2/1980 | Eidt, Jr. et al. | 208/50 X |
| 4,569,752 | 2/1986 | Aldridge et al. | 208/54 X |

*Primary Examiner*—Glenn Caldarola

*Attorney, Agent, or Firm*—Henry E. Naylor

[57] ABSTRACT

A hydrocarbonaceous feed, such as petroleum vacuum distillation bottoms, is upgraded by a combination coking and catalytic slurry hydroconversion process wherein a bottoms fraction from coking is passed through a microfiltration system to remove coke fines, the filtrate passed to a slurry hydroconversion zone, and the bottoms fraction from the slurry hydroconversion zone is also passed through a microfiltration system to remove catalyst particles.

19 Claims, 1 Drawing Sheet

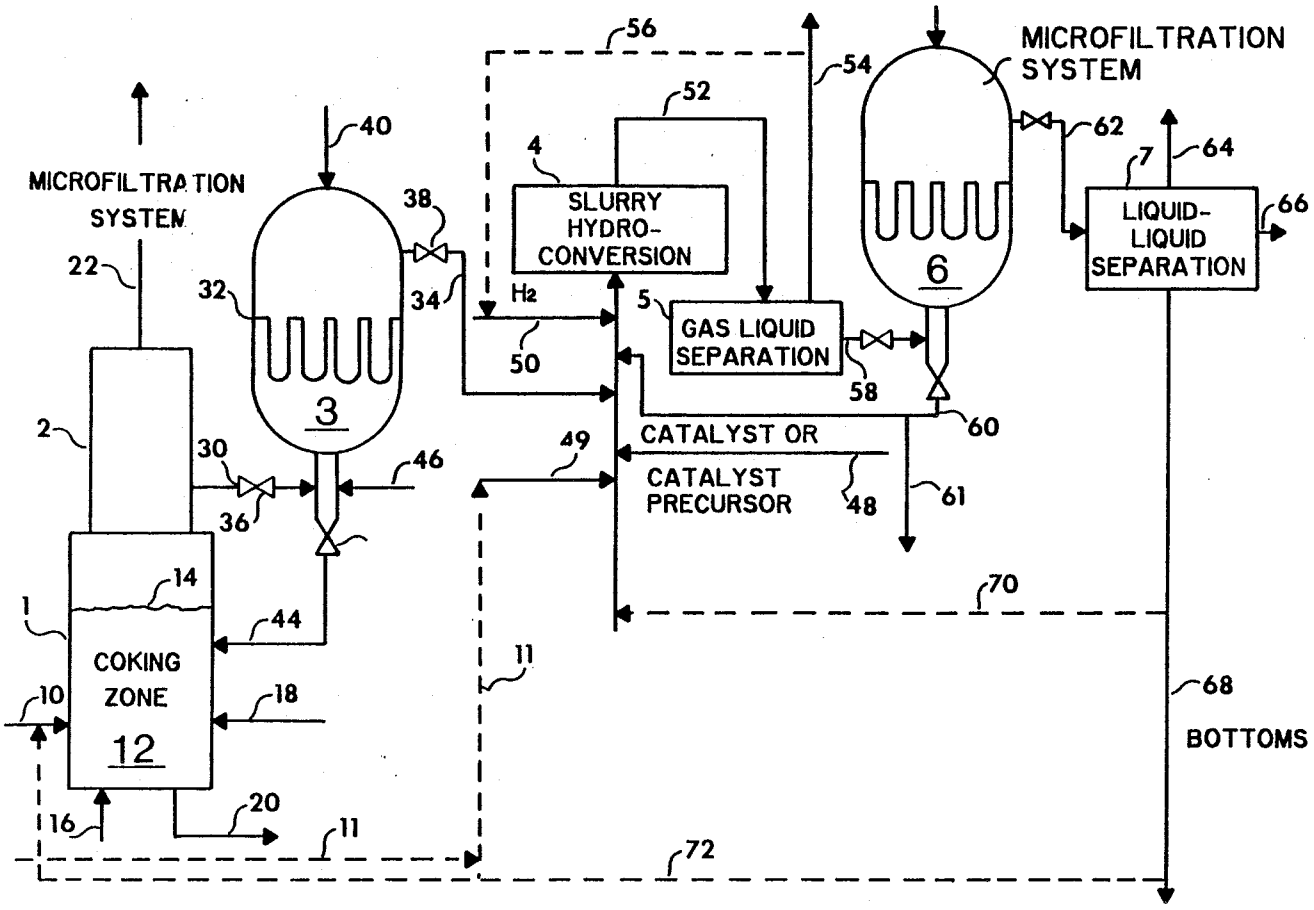
MICROFILTRATION SYSTEM
LIQUID-LIQUID SEPARATION
BOTTOMS
SLURRY HYDRO-CONVERSION
GAS LIQUID SEPARATION
CATALYST OR CATALYST PRECURSOR
COKING ZONE
MICROFILTRATION SYSTEM
H2

COMBINATION COKING AND HYDROCONVERSION PROCESS

This application is a continuation of application Ser. No. 097,121, filed Sept. 16, 1987, now abandoned.

BACKGROUND OF THE INVENTION

1. Field of the Invention

The present invention relates to an integrated coking and hydroconversion process for upgrading hydrocarbonaceous materials wherein a substantially solids-free coker bottoms stream is slurry hydroconverted.

2. Description of the Prior Art

Much work has been done over the years to convert heavy petroleum feedstock to lighter and more valuable liquid products. One process developed for accomplishing this conversion is fluid coking. In conventional fluid coking, a petroleum feedstock is injected into a fluidized bed of hot, fine, coke particles and is distributed uniformly over the surfaces of the coke particles where it is cracked to vapors and coke. The vapors pass through a cyclone which removes most of the entrained coke particles. The vapor is then discharged into a scrubber where the remaining coke particles are removed and the products cooled to condense the heavy liquids. The resulting slurry, which usually contains from about 1 to about 3 weight percent coke particles, is recycled to the coking reactor. The overhead products from the scrubber are sent to fractionation for separation into gas, naphtha, and light and heavy gas oils.

The coke particles in the reactor vessel flow downwardly to a stripping zone at the base of the reactor where stripping steam removes interstitial product vapors from, or between, the coke particles, as well as some adsorbed liquids from the coke particles. The coke particles then flow down a stand-pipe and into a riser which leads to a burner where sufficient air is injected for burning part of the coke and heating the remainder sufficiently to satisfy the heat requirements of the coking reactor where the unburned hot coke is recycled thereto. Net coke, above that consumed in the burner, is withdrawn as product coke.

Another type of fluid coking employs three vessels: a reactor, a heater, and a gasifier. Coke produced in the reactor is withdrawn and is passed through the heater where a portion of the volatile matter is removed. The coke is then passed to a gasifier where it reacts, at elevated temperatures, with air and steam to form a mixture of carbon monoxide, carbon dioxide, hydrogen, nitrogen, water vapor, and hydrogen sulfide. The gas produced in the gasifier is heat exchanged in the heater to provide part of the reactor heat requirement. The remainder of the heat is supplied by circulating coke between the gasifier and the heater.

Still another type of fluid coking process is a so-called once-thru coking process wherein the bottoms fraction from the scrubber is passed directly to a hydrotreating unit or a slurry hydroconversion unit instead of being more conventionally recycled to extinction. The disadvantage of such a once-thru process is that the bottoms fraction is so laden with fine coke particles that it causes plugging of the hydrotreating unit or it comingles with solid catalyst particles in a catalytic slurry hydroconversion unit to such a degree that it is virtually impossible to separate the catalyst particles for recycle purposes.

The term "hydroconversion" is used herein to designate a process conducted in the presence of hydrogen in which at least a portion of the heavy constituents of a hydrocarbonaceous oil is converted to lower boiling products while simultaneously reducing the concentration of nitrogenous compounds, sulfur compounds and metallic contaminants.

Various U.S. patents teach hydroconversion and coking/hydroconversion processes. For example, U.S. Pat. No. 4,134,825 discloses a catalytic slurry hydroconversion process conducted at a pressure of 500 to 5000 psig at elevated temperatures. The catalyst is produced in the oil feed from a catalyst precursor.

U.S. Pat. No. 3,684,689 discloses fluid coking a residuum at a pressure above 150 psig. The coker bottoms are passed to a hydrocracking zone. The stream passed to the hydrocracking zone is a gas oil (see column 3, line 74 and column 6, lines 72–73).

U.S. Pat. No. 2,614,067 discloses coking a topped crude oil in a fluid coker. A gas oil fraction from a fractionator is used as absorber oil in an absorber. The absorber bottoms, which apparently do not include constituents boiling above 1050° F., is passed to a slurry hydrogenation reactor.

U.S. Pat. No. 3,245,900 discloses coking a residuum and sending the coker distillate to a hydrocracking zone.

U.S. Pat. No. 2,888,393 discloses fluid coking at a pressure of 200 to 2000 psig and hydrogenating the entire coker effluent at a pressure ranging from 200 to 2000 psig.

U.S. Pat. Nos. 4,204,943; 4,178,227; and 4,169,038 disclose combination hydroconversion and coking in which the bottoms portion of the hydroconverted product is used as feed to the coking zone.

U.S. Pat. Nos. 4,569,751 and 4,569,752, which are both incorporated by reference herein, describe an integrated coking/hydroconversion process in which the coker bottoms, including materials boiling above 1050° F., are further converted in a catalytic slurry hydroconversion stage. While such an integrated process has met with a degree of success, its drawback is the difficulties associated with the hydroconversion of solids-laden bottom fractions.

Consequently, there is a need in the art for an integrated coking/hydroconversion process in which the scrubber bottoms fraction is made more desirable as a feed for catalytic slurry hydroconversion and hydroconversion bottoms are made more desirable as a feed for the coking reactor.

All boiling points referred to herein are atmospheric pressure equivalent boiling points unless otherwise specified.

SUMMARY OF THE INVENTION

In accordance with the present invention, there is provided an integrated coking and slurry hydroconversion process which comprises the steps of:

(a) treating a hydrocarbonaceous feed having a Conradson carbon content of at least 5 weight percent in a coking zone at coking conditions, including a pressure ranging from zero to about 100 psig, to produce coke and a vapor phase product, including hydrocarbonaceous material comprising constituents boiling above 975° F.;

(b) passing the vapor phase product to a scrubbing zone where it is quenched, thereby producing light and intermediate boiling products, as well as a condensed heavy bottoms fraction containing entrained solids;

(c) passing the heavy bottoms fraction through a microfiltration system characterized as containing a filtering means having a substantially uniform pore size and capable of retaining at least about 95 percent of entrained solids and capable of maintaining an effective flux, thereby resulting in a solids-laden fraction and a substantially solids-free hydrocarbonaceous filtrate;

(d) recycling at least a portion of the solids-laden fraction to the coking zone;

(e) adding a hydroconversion catalyst or hydroconversion catalyst precursor to at least a portion of said substantially solids-free hydrocarbonaceous filtrate to form a mixture;

(f) subjecting at least a portion of said mixture of step (e) to hydroconversion conditions in the presence of hydrogen in a slurry hydroconversion zone to produce a lower boiling hydrocarbonaceous product containing entrained catalyst particles;

(g) passing at least a portion of the lower boiling hydrocarbonaceous product through a microfiltration system characterized as having a substantially uniform pore size and containing a filtering means capable of retaining at least about 95 percent of the entrained catalyst particles while maintaining an effective flux; and (h) recycling at least a portion of the filtered catalyst particles to the slurry hydroconversion zone.

BRIEF DESCRIPTION OF THE DRAWING

The figure is a schematic flow plan of one embodiment of the invention.

DESCRIPTION OF THE PREFERRED EMBODIMENT

Referring to the figure, a hydrocarbonaceous material is passed by line 10 into coking zone 12 in coking reactor 1 in which is maintained a fluidized bed of solids, e.g., coke particles having an average particle size of about 40 to 1000 microns, preferably about 150 microns, shown as having an upper level 14.

Hydrocarbonaceous Feeds

Suitable feeds for introduction into coking zone 12 include heavy hydrocarbonaceous oils; heavy and reduced petroleum crude oil; petroleum atmospheric distillation bottoms; petroleum vacuum distillation bottoms; pitch; asphalt; bitumen; other heavy hydrocarbon residues; tar sand oil; shale oil; coal; coal slurries; liquid products derived from coal liquefaction processes, including coal liquefaction bottoms; and mixtures thereof. Typically, such feeds have a Conradson carbon content of at least 5 weight percent, generally from about 5 to about 50 weight percent, preferably above 7 weight percent. (As to Conradson carbon residue, see ASTM Test D189-65.) Preferably, the feed is a petroleum vacuum residuum.

A fluidizing gas is admitted at the base of the reactor through line 16 in an amount sufficient to obtain a superficial fluidizing gas velocity in the range of 0.5 to 5 feet per second. The fluidizing gas may comprise steam, vaporized normally liquid hydrocarbons, normally gaseous hydrocarbons, hydrogen, hydrogen sulfide and mixtures thereof. Typically, the fluidizing gas will comprise steam. Solids at a temperature above the coking temperature, for example, 100° to 1000° F., preferably from about 150° to 300° F., above the actual operating temperature of the coking zone are admitted into coking reactor 1 by line 18 from the heater or burner, in an amount sufficient to maintain the coking temperature in the range of about 850° to about 1400° F., preferably from about 900° to about 1200° F. The pressure in the coking zone is maintained suitably in the range of about zero to about 150 pounds per square inch gauge (psig), preferably in the range of about 5 to about 45 psig. The lower portion of the coker serves as a stripping zone to remove occluded hydrocarbonaceous material from the coke particles. A stream of relatively stripped cold coke is withdrawn from the stripping zone by line 20 for passage to a burner, heater, or gasifier (not shown) wherein the coke particles are heated. The heater may be operated as a conventional coke burner as disclosed in U.S. Pat. No. 2,881,130, the teachings of which are hereby incorporated by reference. Alternatively, the heater may be operated as a heat exchange zone such as disclosed in U.S. Pat. Nos. 3,661,543; 3,702,516; and 3,759,676, the teachings of which are hereby incorporated by reference.

The heated solids are recycled to coking reactor 1 by line 18 to supply heat for the endothermic coking reaction. The vaporous coker product, which comprises light hydrocarbons and heavy hydrocarbons, including materials boiling above 975° F., as well as entrained coke particles, is passed to scrubber 2. In the scrubber, the vaporous coker product is quenched and a heavy hydrocarbonaceous material is condensed. The lighter products, which include gaseous and normally liquid hydrocarbonaceous material, is removed overhead from the scrubber via line 22 for subsequent conventional fractionation and gas recovery. The bottoms fraction of the scrubber comprises the condensed portion of the vaporous coker product as well as a relatively high concentration, up to about 3 weight percent of fine coke particles. At least a portion of the scrubber bottoms fraction is withdrawn via line 30 and passed to microfiltration system 3. This bottoms fraction has a Conradson carbon content from about 0.5 to 1.5, preferably from about 0.7 to 1.2, and more preferably from 0.8 to 1.0, times the Conradson carbon content of the feed.

Microfiltration systems which are suitable for use in the practice of the present invention include those which have an effective substantially uniform pore size to selectively remove the fine coke or other particles, in the slurry, while maintaining an effective flux (permeation rate). By effective flux we mean that the filtering means of the microfiltration system will be chosen such that the rate of liquid passing through will be at least about 0.05 to 0.5 gallons per minute per square foot (gpm/ft$^2$) of filter area. By effective substantially uniform pore size we mean that substantially all of the pores of the filtering means are approximately the same size and that the pore size is such that it will retain at least about 95 percent, preferably at least about 99 percent, of particles having an average size of about submicron to about 50 microns. Further, the microfiltration systems available for use herein are comprised of a material which is substantially resistant to chemical and physical attack by the scrubber bottoms fraction and hydroconversion product stream. Non-limiting examples of such materials include ceramics, and metals selected from the group consisting of stainless steels and nickel-base alloys such as Monels and Inconels, both available from International Nickel Company Inc., and Hastelloys, available from Cabot Corporation.

Preferred microfiltration systems suitable for use herein include the sintered porous metal membrane systems. Such systems are available from Mott Metallurgical Corporation and Pall Corporation. Such sintered porous metal membranes are generally constructed in a two step procedure from discrete, uniformly sized metal particles. The particles are first pressure formed in the basic shape desired, then heated under pressure. The resultant membrane has a porous structure originating from the spaces between the metal particles. The effective pore size can be determined by the starting particle size and the degree of heating as monitored by density increase. While such systems are available in configurations of flat sheets, tubes and "socks" (tubes attached to so-called tube sheets), the preferred configuration for use herein is a sock configuration as illustrated in the figure hereof. It is within the scope of this invention that the filtering means can also be comprised of wire mesh or a composite of wire mesh and sintered porous membranes.

The microfiltration systems of the instant invention can be operated in either the through-flow mode, the cross-flow mode, or a combination thereof. Preferred is the through-flow mode. In the through-flow mode, feed flow is usually perpendicular to the membrane surface, with all material, except that retained on the membrane surface, exiting as permeate. Through-flow has the advantage of producing high concentrates and thus maximizing liquid recovery. A potential limitation of through-flow processing is the variable permeation rate which, due to coke particle build-up on the membrane surface, starts relatively high, then decreases. This necessitates batchwise, or at least semi-continuous, operation.

In the cross-flow mode, feed flow is parallel to the membrane surface and a flow rate higher than that at which permeate is withdrawn. The resulting feed side turbulence tends to limit solids build-up at the membrane surface. After an initial, sometimes negligible, decline, permeation rates in the cross-flow mode should ideally remain constant, and, with limited material on the membrane surface, relatively high.

An obvious advantage of cross-flow processing is a continuous permeation rate. A disadvantage of cross-flow, relative to through-flow, is the limited recovery achievable and the resultant limitation on concentrates. The through-flow mode can be operated under constant feed pressure on constant feed flow conditions. The method will result in gradual build-up of solids on the membrane surface. These solids will have to be removed periodically to continue the process. For purposes of the present invention, constant feed flow conditions are preferred. This results in a variable pressure operation but constant permeate, or filtrate, output. The process is continued to preset maximum pressure, at which point the feed flow must be stopped and retained material (filter cake) removed from the membrane prior to the next cycle.

Now turning again to the figure, feed enters near the bottom of the microfiltration system via line 30 and fills the lower space around the membrane socks 32. Liquid filters through the socks while solids are retained on their outside surfaces. The clean filtrate, after filling the inside of the socks and the head of the housing, exits the permeate outlet 34. In an inverted, or "inside/out" design, the tube sheet to which the membrane socks are attached, is located at the bottom of the housing and the socks inverted with their open ends pointed down. Feed enters the unit at the feed inlet, fills the bottom of the housing and the inside of the socks where the solids collect. Solids-free permeate or filtrate exits the outlet located above the tube sheet near the bottom of the housing.

At the end of each processing cycle, typically at about 40 psi, the feed inlet valve 36 is closed and, with the permeate outlet valve 38 also closed, the filter is backflushed via line 40 with a pulse of fluid for a short duration to dislodge caked solids. The fluid may be vapor, liquid, or a mixture of vapor and liquid. Usually, this backpulse will be a pressure of about 20 to about 200 psi, preferably about 40 to about 100 psi. The bottom drain valve 42 is then opened and the backpulse gas expands pushing the permeate at the top back through the membranes, dislodging the solids cake, regenerating the membranes and forcing the solids-laden concentrate out the drain and through line 44 to the coking zone. The regeneration cycle typically requires about 30–45 seconds. It is understood that at least a portion of this solids-laden concentrate can be blended with the hydrocarbonaceous oil for introduction into the coking reactor.

It is also within the scope of this invention to introduce into the microfiltration system via line 46 other solids-containing hydrocarbonaceous materials such as catalytic cracker bottoms, hydroconversion bottoms, and oil sludges.

The filtrate from the microfiltration system 3, which is now substantially free of solids, is passed by line 34 to the slurry hydroconversion zone 4. A catalyst or catalyst precursor is added by line 48 to the bottoms fraction carried in line 34. Alternatively, the catalyst, or catalyst precursor, may be introduced directly into slurry hydroconversion zone 4. A hydrogen-containing gas is introduced by line 50 into line 34 or directly into hydroconversion zone 3. It is understood that fresh hydrocarbonaceous feed, which may be the same as that introduced in coking reactor 1, for example by removing a portion of feed 10 by line 11, is introduced into the hydroconversion zone by line 49. The feed requirements are the same as for the coking reactor.

The Hydroconversion Catalyst

The hydroconversion catalyst introduced into the filtrate fraction to form a slurry may be any suitable hydroconversion catalyst or catalyst precursor suitable for use in slurry processes. The catalyst may comprise a Group IVB, VB, VIB, VIIB or VIII metal, metal oxide or metal sulfide or mixtures thereof of the Periodic Table of Elements and may be supported or unsupported catalysts. The Periodic Table of Elements referred to herein is in accordance with the table of E. H. Sargent and Company, copyright 1962, Dyna Slide Company. Instead of a preformed catalyst, a catalyst precursor may be used, such as an oil soluble, oil dispersible, or thermally decomposable metal compound such as, for example, the catalyst precursor described in U.S. Pat. No. 4,226,742, the teachings of which are incorporated herein by reference. Catalysts comprising cobalt, molybdenum, nickel, tungsten, iron and mixtures thereof on an alumina-containing support or on a carbonaceous support such as coal or coke are also suitable. The amount of catalyst or catalyst precursor added to the filtrate will vary widely depending on the type of catalyst or catalyst precursor used. Preferred catalysts are carbonaceous solids having an average particle size of less than 10 microns in diameter or the ashes thereof, such as the catalysts described in U.S. Pat. Nos. 4,204,943; 4,169,038 and 4,178,227, the teachings of which are incorporated herein by reference. These catalysts may be derived from the metals-containing fines of a coke gasification process.

Slurry Hydroconversion Operating Conditions

Suitable conditions in the slurry hydroconversion zone are sumarized in Table I.

TABLE I

| | Broad Range | Preferred Range |
|---|---|---|
| Temperature, °F. | 650 to 1000 | 800 to 900 |
| Hydrogen Partial Pressure, psig | 100 to 5000 | 300 to 2000 |

In the slurry hydroconversion zone, at least 10 weight percent, preferably at least 50 weight percent, more preferably at least 75 weight percent of the materials boiling above 975° F. that are present in the heavy bottoms fraction subjected to slurry hydroconversion conditions is converted to lower boiling products.

The hydroconversion zone effluent is removed by line 52 and passed into a gas-liquid separation zone 5 wherein the normally gaseous phase is separated from a normally liquid phase. The gaseous phase is removed from separation zone 5 by line 54. Alternatively, the gaseous phase, which comprises hydrogen, may be recycled by line 56, preferably after removal of undesired constituents, to the slurry hydroconversion zone via line 50. The normally liquid phase, which comprises the hydroconverted hydrocarbonaceous oil having a decreased Conradson carbon content, but containing solid catalyst particles, is passed by line 58 to microfiltration system 6. The microfiltration system 6 is substantially the same type as microfiltration system 3, which has been described in detail above. At least a portion of the solids, which contain catalytically active species, from filtration system 6 is recycled by line 60 to the slurry hydroconversion zone 4. Excess solids can be removed from the system via line 61. The substantially solids-free filtrate is passed by line 62 to separation zone 7 for fractionation by conventional means, such as distillation, into various fractions such as light, medium boiling and heavy bottoms fractions. The light fraction is removed by line 64. The medium boiling fraction is removed by line 66. The heavy bottoms fraction is removed by line 68 and, if desired, at least a portion of the bottoms fraction may be recycled to hydroconversion zone 4 by line 70 and/or to coking zone 12 by line 72.

The following examples are provided to illustrate the invention.

EXAMPLES

EXAMPLES 1 and 2

A vacuum residuum having a Conradson carbon content of 22.1 weight percent and an API Gravity at 60° F. of 6.9 was subjected to fluid coking at a temperature of about 950° F. The coker unit was operated in both a once-through mode and a more conventional recycle mode. That is, a recycle mode wherein a scrubber bottoms fraction is recycled to extinction. The unit was lined-out at 42 kB/SD (1,000 barrels/stream day), with scrubber bottoms recycled to the reactor in preparation for testing. During a first recycle test (24 hour duration), samples of product were collected and analyzed. The unit then underwent transition from recycle mode to once-through (O/T) mode by slowly, over a period of about 6 hours, reducing the percentage of scrubber bottoms recycled to the reactor until all of the scrubber bottoms were withdrawn as product. In parallel, the feed rate was increased from 42 kB/SD to 52 kB/SD, keeping constant, the total feed rate to the reactor. Samples of once-through scrubber bottoms were collected over a period of about 9 hours and analyzed. The unit was returned to recycle mode and samples were again collected over a 24 hour period and analyzed. Analysis results for both the recycle and once-through modes are given in Table II below. The data for the recycle mode is an average of the two test periods.

TABLE II

| | Operating Mode | | |
|---|---|---|---|
| Yields, wt % FF | Recycle (Rec) | Once-Through (O/T) | O/T-Rec |
| $H_2S$ | 0.73 | 0.54 | −0.19 |
| $C_1$-$C_4$ | 13.76 | 12.08 | −1.68 |
| Total Liquid | 52.70 | 61.12 | +8.42 |
| Gross Coke | 32.81 | 26.26 | −6.55 |
| | 100.00 | 100.00 | 0 |

The above table shows the advantages of the coking process of the present invention versus conventional fluid coking. For example, total liquid yield is increased by more than 15 percent, coke make is decreased by about 20 percent, and $C_1$-$C_4$ make is decreased by more than 12 percent.

EXAMPLE 3

A portion of the scrubber bottoms stream from a fluid coking process operated in once-through mode, as set forth in Example 1 above, was split into four separate streams. Each was passed, at a temperature of 400° F., through a microfiltration system, wherein the pore size of the filtering means for each stream was different, as indicated by 3 in the sole Figure and Table III hereof. The membrane sock of the microfiltration system was a 0.5 $ft^2$ sintered stainless steel single element having a substantially uniform pore size as set forth in Table III below. Each time the system reached a pressure of 80 psi, introduction of the system into the microfiltration system was stopped and the membrane sock element was backflushed with nitrogen to remove the filter cake after which introduction of the stream into the system was resumed.

TABLE III

| Pore Size | 9 Micron | 10 Micron | 2 Micron | 5 Micron |
|---|---|---|---|---|
| Number cycles | 15 | 14 | 17 | 16 |
| Flux Rate, gpm/$ft^2$ | 0.16 | 0.16 | 0.16 | 0.1–0.12 |
| Solids Conc., Wt. % | 0.6–4.1 | 1.9–2.3 | 1.2–3.9 | 0.4–3.5 |
| Median Particle Size Range (Microns) | 4–10 | 6–34 | 10.3–23.6 | 9.1–22.9 |
| Filtrate Solids Conc., ppm | 0–50 | 0–50 | 0.50 | 0.35 |
| Cake Thickness, inches | 0.02–0.23 | 0.09–0.56 | 0.23–0.60 | 0.12–0.5 |
| Cycle Time, | 10–65 | 20–97 | 46–134 | 42–295 |

EXAMPLE 4

A scrubber bottoms stream resulting from fluid coking in once-through mode was passed through a microfiltration system as set forth above, but containing a membrane sock comprised of a 0.94 $ft^2$ single sintered stainless steel element having an average pore size of 0.5 microns. The stream was passed through the microfiltration system for a period of 5 days at a temperature of 400° F. to 600° F. Passage of the stream through the microfiltration system was stopped each time the pressure reached 20 to 40 psi, whereupon the membrane socks were backflushed with a nitrogen pulse to remove the filtrate cake after which passage of the stream was resumed for another cycle. The results are set forth in Table IV below.

TABLE IV

| | |
|---|---|
| Pore Size, microns | 0.5 |
| Number cycles | 130 |
| Flux Rate, gpm/ft$^2$ | 0.2–0.53 |
| Solids Conc., wt % | 1.6–6.0 |
| Med. Size Microns | 50–78 |
| Filtrate Solids Conc., ppm | 0–44 |
| Cake Thickness, inches | 0.2–1.0 |
| Cycle Time, minutes | 9–92 |

EXAMPLE 5

The feedstock for this experiment consisted of a blend of equal weights of Heavy Arabian vacuum residuum and a filtered, solids-free once-through coker bottoms that was derived from coking Heavy Arabian vacuum residuum. Properties of the respective feeds are given in Table V.

TABLE V

| | Feedstock Inspections | |
|---|---|---|
| | Heavy Arabian Vacuum Resid | Once-Through Coker Bottoms (ex solids) |
| 975 + °F. Content, wt % | 88.6 | 99.9 |
| Conradson Carbon, wt % | 20.3 | 24.3 |
| Sulfur, wt % | 5.1 | 5.7 |
| Hydrogen, wt % | 9.00 | 10.29 |
| Carbon, wt % | 84.31 | 83.76 |

To illustrate the process of the present invention, the catalyst comprised a mixture of fresh catalyst and recycle catalyst.

Preparation of Fresh Catalyst

Step I

A stainless steel tank was charged with 725 pounds of residuum that contained 56.3 wt% components boiling above 975° F., a Conradson carbon content of 15.1 wt% and an initial boiling point of 471° F. After flushing with nitrogen, the tank was heated with stirring to 176° F. whereupon 71.35 pounds of a phosphoric acid modified aqueous solution of phosphomolybdic acid was added over the course of about 15 seconds. This solution, which contained 5.140 weight percent molybdenum and 0.373 weight percent phosphorus, was prepared at room temperature by adding 0.552 pounds of phosphoric acid (85 weight percent $H_3PO_4$) to 70.8 pounds of a commercially-supplied solution of phosphomolybdic acid and water. Stirring was continued at 176° F. for 30 minutes whereupon the wet catalyst precursor concentrate was transferred to a vessel for removal of water.

Step II

The wet catalyst precursor concentrate of Step I was charged to an open-top drum that was equipped with internal and externally mounted high pressure steam coils. Temperature was increased to 275° F. over the course of approximately 45 minutes to remove bulk water.

Step III

The mixing tank of Step I was charged with the dry catalyst precursor concentrate from Step II, and after flushing with nitrogen, was heated with stirring to a temperature of 325° F., whereupon 50 psig hydrogen sulfide was added and stirring was continued at 325° F. under 50 psig $H_2S$ pressure for 40 minutes to complete the sulfiding reaction.

Step IV

While still at 325° F. the mixing tank was vented and then purged with nitrogen to remove hydrogen sulfide.

Step V

Upon removal of $H_2S$ in Step IV, the mix tank was heated with stirring to 725° F. and was held at this temperature with stirring for a period of 20 minutes under a regulated, autogenous pressure of 25 psig. In the course of this treatment, a portion of the lower boiling components of the residuum was removed by distillation. The resultant catalyst concentrate (HFC-133), which was determined to contain 0.45 wt% Mo by assay, was cooled and stored under nitrogen for future use.

Preparation of Recycle Catalyst

The recycle catalyst was obtained by filtering a hot separator bottoms product, i.e., an 800+° F. fraction that contains heavy gas oil, unconverted 975° F. bottoms and catalyst solids, from the hydroconversion upgrading of Heavy Arabian vacuum residuum in continuous unit operation wherein fresh catalyst was supplied as a concentrate of phosphomolybdic acid solubilized in residuum. Hydroconversion conditions similar to those cited in this example resulted in conversion of 94% of 975+° F. bottoms to 975−° F. products. Filtration of 58 g of hot separator bottoms product from this operation (PHC Run-33 balance-5) gave 0.97 g of recycle catalyst solids that contained 7.6 wt% Mo.

Hydroconversion Experiment

To a 300 cc Autoclave Engineers magnetically stirred autoclave was charged 117 g of the blend of Heavy Arabian vacuum residuum and once-through coker bottoms, 0.33 g of recycle Mo catalyst recovered from PHC Run-33 balance-5 hot separator bottoms product and 2.67 g of fresh catalyst concentrate (preparation HFC-133).

The autoclave was flushed with hydrogen, pressured to 1350 psig with hydrogen, heated with stirring to 725° F. and held at 725° F. with stirring for 20 minutes.

At this point the autoclave pressure was adjusted to 2100 psig, a flow of hydrogen was started through the autoclave to maintain an outlet gas rate of 0.36 liter/minute (as measured at room temperature and atmospheric pressure after caustic scrubbing) and temperature was increased to 830° F. to carry out the hydroconversion reaction.

Upon completion of a 180 minute stirred contact at 830° F., the flow of hydrogen was stopped, and the autoclave was cooled quickly to about 200° F., whereupon gaseous products were vented from the reactor, caustic scrubbed, measured (volume) and collected for analysis by mass spectrometry.

Liquids and solid products remaining in the reactor were transferred to a distillation flask and distilled under vacuum to obtain the 800−° F. liquid products and the 800+° F. fraction which, like the hot separator product from continuous unit operations, contains heavy gas oil, unconverted 975+° F. bottoms and catalyst solids. The 800+° F. bottoms was subsequently used as feed for coking studies.

EXAMPLE 6

Determination of Coke Yield from Catalyst-Containing Hydroconversion Bottoms Coke yield was determined in a microcarbon residue test that gives results comparable to those obtained in the Conradson carbon test (ASTM procedure D-189).

In the microcarbon residue test, a weighed quantity of sample is placed in a Pyrex vial and is subjected to heating under an inert (nitrogen) atmosphere to 932° F. in a controlled manner for a specific time. Under the severe heating conditions, the sample undergoes thermal cracking (i.e., coking) and volatile products that are formed are swept away by a flow of nitrogen. The carbonaceous residue (coke residue) that remains is calculated as a percentage of the original sample and is reported as "percent carbon residue".

Typically, a sample of from 0.1 to 0.5 g is charged to a ½ dram capacity Pyrex vial that is 33 mm long and has an outer diameter of 12 mm. The vial is then placed in a coking oven at 212° F. or less, said oven comprising a resistance-wire heated chamber that measures 85 mm (diameter)×100 mm (depth) that is equipped for operation with flow-through nitrogen. Upon purging with nitrogen and with a constant flow of nitrogen set at 150 cc/minute, the sample is heated to 932° F. at a rate of 10°-15° C./minute. After holding for 15 minutes at 932° F., the furnace power is shut off and the furnace is allowed to cool, while maintaining approximately 600 cc/minute nitrogen flow. At about 480° F. the sample vial is transferred from the oven to a nitrogen-purged dessicator for further cooling to room temperature. The vial is then weighed to determine the yield of carbonaceous residue (coke).

When a sample of catalyst-containing 800+° F. bottoms from Example 5 was pyrolyzed under conditions of this microcarbon residue test, it was found that the carbonaceous residue (or coke) yield was 46.62 weight percent.

Example 7

Determination of Coke Yield from Catalyst-Free Hydroconversion Bottoms

A sample of 17.90 g of 800+° F. bottoms from Example 5 was filtered over a No. 2 grade Whatman paper at 350° F. to remove catalyst-containing solids. The filtrate, i.e., catalyst-free hydroconversion bottoms, was set aside and the filter cake was washed with toluene to remove adhering oil and was then dried under vacuum at 212° F. to remove toluene. In this manner there was recovered 0.21 g of catalyst-containing solids. Thus, the 800+° F. bottoms was comprised of 1.17 weight percent of catalyst-containing solids and 98.83 weight percent of 800+° F. liquid products.

Upon pyrolysis under microcarbon test conditions, it was found that the catalyst-containing solids gave a coke yield of 96.05 weight percent and that the solids-free 800+° F. liquid gave a coke yield of 34.84 weight percent.

The overall yield of coke obtained when the 800+° F. oil and catalyst-containing solids are coked separately was found to be substantially less than that obtained when the 800+° F. oil and catalyst-containing solids are in admixture (Table VI).

TABLE VI

EFFECT OF SOLIDS REMOVAL ON COKING OF HYDROCONVERSION BOTTOMS

| Without Filtration | | | | With Filtration | | | |
|---|---|---|---|---|---|---|---|
| Component | Wt. Sample, g. | Wt. Fraction, Coke in Sample | Wt. Coke, g. | Component | Wt. Sample, g. | Wt. Fraction, Coke in Sample | Wt. Coke, g. |
| 800 + °F. Bottoms From Example 1 | 100 | 0.4662 | 46.62 | 800 + °F. Bottoms Oil | 98.83 | 0.3484 | 34.43 |
| | | | | Cat-Containing Solids | 1.17 | 0.9605 | 1.12 |
| | | TOTAL | 46.62 | | | TOTAL | 35.55 |

What is claimed is:

1. An integrated coking and hydroconversion process which comprises the steps of:

(a) treating a hydrocarbonaceous feed having a Conradson carbon content of at least 5 weight percent in a coking zone maintained under fluidized coking conditions, including a pressure ranging from zero to about 100 psig, to produce coke and a vapor phase product, including hydrocarbonaceous comprising constituents boiling above 975° F.;

(b) passing the vapor phase product to a scrubbing zone;

(c) separating a heavy bottoms fraction in the scrubbing zone having a Conradson carbon content of at least about 5 weight percent, including said constituents boiling above 975° F., from said hydrocarbonaceous material;

(d) passing the heavy bottoms fraction through a microfiltration system characterized as containing a filtering means comprised of a sintered porous ceramic or metal membrane and having a substantially uniform pore size capable of retaining at least 95 percent of the solids and capable of maintaining an effective flux, thereby resulting in a solids-laden fraction and a hydrocarbonaceous filtrate;

(e) recycling at least a portion of the solids-laden fraction to the coking zone;

(f) adding a hydroconversion catalyst or hydroconversion catalyst precursor to at least a portion of said hydrocarbonaceous filtrate to form a mixture;

(g) subjecting at least a portion of said mixture of step (f) to hydroconversion conditions, in the presence of hydrogen, in a slurry hydroconversion zone to produce a hydroconverted oil;

(h) passing the hydroconverted oil to a microfiltration system substantially the same as the microfiltration system in (d), above, wherein solids suspended in the hydroconverted oil are removed; and (i) passing the filtrate resulting from the filtration of step (h) above to a liquid-liquid separation wherein the resulting heavy fraction is recycled to the coking zone.

2. The process of claim 1 wherein the hydrocarbonaceous oil is a vacuum distillation residuum.

3. The process of claim 1 wherein the filtering means of the microfiltration systems are comprised of a sintered porous metal membrane.

4. The process of claim 3 wherein the metal is selected from iron- and nickel-based alloys.

5. The process of claim 4 wherein the iron-based alloys are stainless steels.

6. The process of claim 1 wherein the coking zone is maintained at a temperature of about 850° F. to about 1400° F. and a pressure from about zero to about 150 psig.

7. The process of claim 6 wherein the coking zone is maintained at a temperature from about 900° F. to about 1200° F. and a pressure from about 5 to about 45 psig.

8. The process of claim 1 wherein another solids-laden stream is passed through the microfiltration system along with the scrubber bottoms fraction, which other solids-laden stream is selected from the group consisting of catalytic cracker bottoms, hydroconversion bottoms, and oil sludges.

9. The process of claim 1 wherein the substantially solids-free filtrate is hydrotreated at a temperature from about 600° F. to 800° F., a pressure from about 400 to 10,000 psi and a hydrogen treat rate from about 500 to about 10,000 standard cubic feet per barrel of feed.

10. The process of claim 9 wherein the filtering means of the microfiltration system is comprised of a sintered porous metal membrane whose metal is selected from the group consisting of iron-and nickel-based alloys chemically and physically resistant to scrubber bottoms fraction.

11. The process of claim 1 wherein the flux is at least about 0.1 gpm/ft$^2$.

12. The process of claim 1 wherein the hydroconversion conditions include pressures ranging from about 100 to about 5,000 psig and a temperature ranging from about 650° F. to about 1000° F.

13. The process of claim 12 wherein the hydroconversion conditions include a pressure ranging from about 300 to about 2000 psig and a temperature ranging from about 800° F. to about 900° F.

14. The process of claim 1 wherein the hydrocarbonaceous feed of said coking zone has a Conradson carbon content of at least 7 weight percent.

15. The process of claim 1 wherein the heavy bottoms fraction has a Conradson carbon content of at least about 7 weight percent.

16. The process of claim 1 wherein the hydroconversion catalyst precursor is an oil-soluble metal compound or a thermally decomposable metal compound.

17. The process of claim 1 wherein the heavy bottoms fraction of step (b) comprises at least about 10 weight percent materials boiling above 975° F.

18. The process of claim 1 wherein at least 10 weight percent of the 975+° F. materials of said portion of heavy bottoms fraction are converted to lower boiling products.

19. The process of claim 1 wherein a portion of the hydrocarbonaceous feed is passed directly to the slurry hydroconversion zone.

* * * * *